US010203635B2

(12) United States Patent
Momiyama

(10) Patent No.: US 10,203,635 B2
(45) Date of Patent: Feb. 12, 2019

(54) IMAGE FORMING APPARATUS, METHOD FOR IMAGE FORMING APPARATUS, AND PROGRAM

(71) Applicant: CANON KABUSHIKI KAISHA, Tokyo (JP)

(72) Inventor: Daisuke Momiyama, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 112 days.

(21) Appl. No.: 15/494,280

(22) Filed: Apr. 21, 2017

(65) Prior Publication Data

US 2017/0315480 A1 Nov. 2, 2017

(30) Foreign Application Priority Data

Apr. 28, 2016 (JP) ..... 2016-091446

(51) Int. Cl.
*G03G 15/00* (2006.01)
*G03G 15/20* (2006.01)

(52) U.S. Cl.
CPC ..... *G03G 15/2028* (2013.01); *G03G 15/6529* (2013.01)

(58) Field of Classification Search
CPC ..... G03G 15/6529; G03G 15/2028; G03G 15/657; G03G 15/6573
See application file for complete search history.

(56) References Cited

U.S. PATENT DOCUMENTS 5,042,791 A * 8/1991 Stemmle ..... B65H 15/00 271/186
6,018,398 A * 1/2000 Bunker ..... G06K 15/00 358/1.15
6,393,252 B1 * 5/2002 Yamagishi ..... G03G 15/234 399/401
2003/0185610 A1 * 10/2003 Jeong ..... G03G 15/231 399/401

FOREIGN PATENT DOCUMENTS

JP 06169368 A * 6/1994
JP 2008-262152 A 10/2008
JP 2008-276014 A 11/2008
JP 2015-169732 A 9/2015
JP 2016-021048 A 2/2016

* cited by examiner

*Primary Examiner* — David Banh
(74) *Attorney, Agent, or Firm* — Canon U.S.A., Inc. IP Division

(57) ABSTRACT

An image forming apparatus includes first and second conveyance and calculation units, a reverse unit, a control unit, an image forming unit, and a stack unit to stack sheets. A recording material is conveyed from the stack unit to the image forming unit. The recording material is conveyed reversely, and is conveyed to a double-sided conveyance path and to the image forming unit. Without causing a recording material to wait in the reverse unit, a first recording material is conveyed from the stack unit, then a second recording material is conveyed, and subsequently a third recording material is conveyed. A conveyance interval time and a maximum waiting time are calculated. When the (Continued)

conveyance interval time exceeds the maximum waiting time, the second recording material conveyance starts at timing based on a waiting time after conveyance of the first recording material, and the third recording material conveyance starts at a timing.

10 Claims, 9 Drawing Sheets

IMAGE FORMING APPARATUS, METHOD FOR IMAGE FORMING APPARATUS, AND PROGRAM

BACKGROUND OF THE INVENTION

Field of the Invention

The disclosure relates to an image forming apparatus, a method for the image forming apparatus, and a program.

Description of the Related Art

When performing printing on both sides of a recording material, a conventional image forming apparatus prints an image on a front side of the recording material that is conveyed from a cassette or the like and conveys the recording material to a reverse conveyance path. The image forming apparatus then reverses a conveyance direction of the recording material that is conveyed to the reverse conveyance path to convey the recording material to a double-sided conveyance path. The recording material conveyed to the double-sided conveyance path is conveyed to an image forming unit again and an image is printed on a back side of the recording material.

A method has been known of alternately performing printing on a front side and a back side while at least one recording material having an image printed on a front side thereof is caused to wait in a double-sided conveyance path in order to increase the printing number per unit time. That is, with the method, conveyance of a recording material from a cassette and conveyance of a recording material from the double-sided conveyance path are performed alternately. In an image forming apparatus described in Japanese Patent Laid-Open No. 2016-21048, while a recording material P1 having an image printed on a front side thereof is caused to wait in a double-sided conveyance path, an image is printed on a front side of a recording material P2, followed by printing images on a back side of the recording material P1 and a front side of a recording material P3 in this order.

The image forming apparatus described in Japanese Patent Laid-Open No. 2016-21048 is configured so that a fixing device that fixes an image onto a recording material and reverse rollers that reverse a conveyance direction of the recording material in a reverse conveyance path are driven by the same motor for cost reduction. Though a solenoid that switches a rotation direction of the reverse rollers is provided between the motor and the reverse rollers, a clutch that switches a driving force to be transmitted from the motor to the reverse rollers is omitted. That is, when printing is performed on both sides of a plurality of recording materials, it is difficult to cause a recording material to wait in the reverse conveyance path by stopping the reverse rollers. When the motor is stopped and the fixing device is stopped while printing is being performed, rotation of the reverse rollers also is able to be stopped, but it takes much time to recover the fixing device and downtime is caused.

In this manner, the image forming apparatus described in Japanese Patent Laid-Open No. 2016-21048 alternately performs printing on a front side and a back side in a configuration in which it is difficult to cause a recording material to wait in the reverse rollers. That is, the image forming apparatus described in Japanese Patent Laid-Open No. 2016-21048 sequentially conveys the recording material P2 from a cassette, the recording material P1 from the double-sided conveyance path, and the recording material P3 from the cassette to an image forming unit at a fixed conveyance interval that is set in accordance with image formation conditions. The image formation conditions correspond to image formation modes according to a type (thin paper, plain paper, or thick paper) or a size of a recording material.

In a case where an image is fixed onto thick paper, for example, higher fixing temperature is required compared to a case where an image is fixed onto thin paper, so that an interval at which recording materials are conveyed needs to be made wide. In a case where images are continuously fixed onto small-sized recording materials, an interval at which the recording materials are conveyed needs to be made wide in order to suppress a temperature rise in an end portion of the fixing device. When the interval at which the recording materials are conveyed is made wide in this manner, the recording material P1 having an image printed on a front side thereof waits in the double-sided conveyance path for a longer time. As a result, there may be a case where the recording material P2 conveyed from the cassette collides with the recording material P1 that is waiting in the double-sided conveyance path and jamming (sheet jamming) occurs. That is, usability is reduced.

SUMMARY OF THE INVENTION

In a configuration in which a recording material is not allowed to wait in a reverse unit, printing is performed on both sides of a plurality of recording materials while ensuring image quality regardless of types or sizes of the recording materials without reducing usability.

According to an aspect of the present invention, an image forming apparatus includes an image forming unit that forms an image on a recording material, a stack unit on which a plurality of recording materials are stacked, a first conveyance unit that conveys a recording material from the stack unit to the image forming unit, a reverse unit that reverses a conveyance direction of a recording material, which passes through the image forming unit and is conveyed to a reverse conveyance path, and conveys the recording material to a double-sided conveyance path connected to the image forming unit, a second conveyance unit that conveys a recording material from the double-sided conveyance path to the image forming unit, wherein, without causing a recording material to wait in the reverse unit, the first conveyance unit conveys a first recording material from the stack unit, then the second conveyance unit conveys a second recording material waiting in the double-sided conveyance path after passing through the image forming unit, and subsequently the first conveyance unit conveys a third recording material from the stack unit, a first calculation unit that calculates a conveyance interval time of a recording material based on an image formation condition of the image forming unit, a second calculation unit that calculates a maximum waiting time, during which the second recording material is allowed to wait in the double-sided conveyance path after conveyance of the first recording material is started by the first conveyance unit, so as to prevent the first recording material from contacting the second material, and a control unit that, when the conveyance interval time calculated by the first calculation unit is longer than the maximum waiting time calculated by the second calculation unit, starts conveyance of the second recording material by the second conveyance unit at timing at a lapse of a first time shorter than or equal to the maximum waiting time after the conveyance of the first recording material is started by the first conveyance unit, and further starts conveyance of the third recording material by the first conveyance unit at timing at a lapse of a second time obtained by adding a time difference between the conveyance interval time and the first time to the conveyance interval time after the conveyance of the second recording material is started by the second conveyance unit.

Further features of the present invention will become apparent from the following description of embodiments with reference to the attached drawings.

DESCRIPTION OF THE EMBODIMENTS

Embodiment 1

Figure 1:
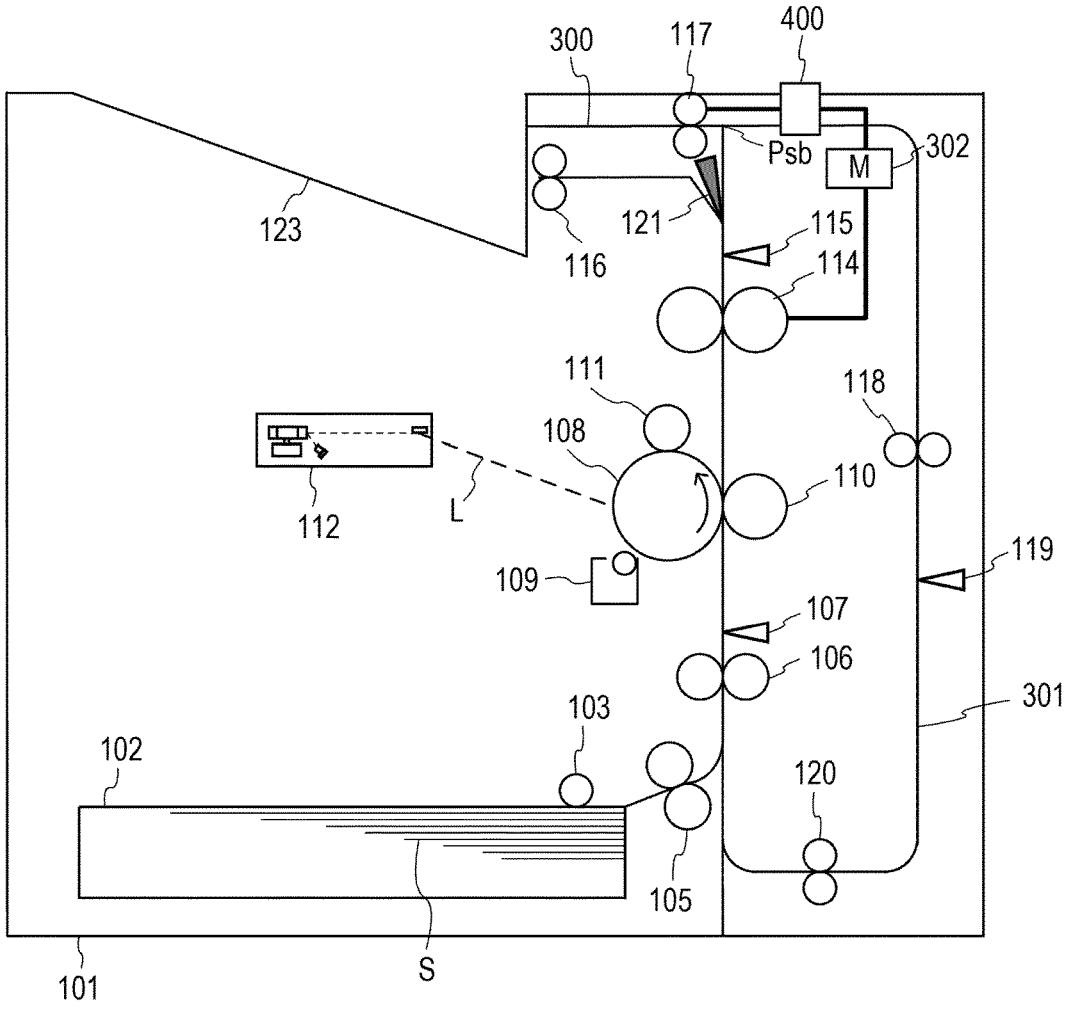
FIG. 1 is a schematic structural view of an image forming apparatus.

In the present embodiment, an electrophotographic laser beam printer 101 (hereinafter, represented as a printer 101) is indicated as an image forming apparatus. FIG. 1 is a schematic structural view of the printer 101. When receiving a print instruction from a video controller 210 (illustrated in FIG. 2), the printer 101 controls each member, which will be described below, by an engine CPU 201 (illustrated in FIG. 2, and hereinafter, represented as a CPU 201) and executes series of printing processing.

A sheet S serving as a recording material is stacked on a cassette 102 serving as a stack unit. When a feeding roller 103 serving as a first conveyance unit rotates, the sheet S stacked on the cassette 102 is fed. When a plurality of sheets S are fed by the feeding roller 103 in an overlapping manner, the sheets S are separated to each one sheet S by a separation roller 105 and then conveyed to a conveyance path on a downstream side.

The sheet S fed by the feeding roller 103 reaches a top sensor 107. When a leading edge (an edge on a downstream side in a conveyance direction) of the sheet S is detected by the top sensor 107, a toner image is started to be formed by an image forming unit. The image forming unit includes a photosensitive drum 108, a developing device 109, a transfer roller 110, a charging roller 111, a laser exposure device 112, and a fixing device 114.

The photosensitive drum 108 rotates in an arrow direction of FIG. 1. The charging roller 111 uniformly charges a surface of the photosensitive drum 108. The laser exposure device 112 irradiates the photosensitive drum 108 with laser light L in accordance with a video signal notified from the video controller 210. Thereby, an electrostatic latent image is formed on the surface of the photosensitive drum 108. Toner adheres to the electrostatic latent image, which is formed as described above, by the developing device 109, and a toner image is visualized.

The photosensitive drum 108 and the transfer roller 110 form a nip portion therebetween. The nip portion is called a transfer position. A conveyance roller 106 conveys the sheet S to the transfer position so as to match timing with the toner image formed on the photosensitive drum 108. At the transfer position, voltage having a polarity opposite to that of the toner image is applied to the transfer roller 110, and the toner image formed on the photosensitive drum 108 is transferred to the sheet S. The sheet S on which the toner image is transferred is conveyed to the fixing device 114. The fixing device 114 applies heat and pressure to the sheet S to fix the toner image onto the sheet S. A fixing discharge sensor 115 detects the sheet S that has passed through the fixing device 114. In accordance with timing when the sheet S is detected by the fixing discharge sensor 115, timing when a flapper 121 that decides a conveyance destination of the sheet S is switched is controlled. When printing ends, the flapper 121 is switched to a discharge direction so that the sheet S is discharged onto a discharge tray 123 by a discharge roller 116.

When double-sided printing is performed, the flapper 121 is switched to a double-sided direction so that the sheet S having an image printed on a first side (front side) thereof is conveyed to a reverse conveyance path 300. An SB roller 117 (switch-back roller) serving as a reverse unit rotates in a direction in which the sheet S is drawn to the reverse conveyance path 300, and then rotates in a reverse direction in which the sheet S is drawn out from the reverse conveyance path 300 and conveyed to a double-sided conveyance path 301. The SB roller 117 rotates in the reverse direction at timing when a tail edge (an edge on an upstream side in the conveyance direction) of the sheet S reaches a double-sided reverse position Psb.

A motor 302 is a driving source for driving the fixing device 114 and the SB roller 117. Though a solenoid 400 that switches a rotation direction of the SB roller 117 is provided between the motor 302 and the SB roller 117, a clutch that switches a driving force to be transmitted from the motor 302 to the SB roller 117 is omitted. When the fixing device 114 is stopped while printing is being performed, it takes much time to perform recovery, so that the motor 302 is not stopped during printing basically. That is, the SB roller 117 continuously rotates in the direction in which the sheet S is drawn to the reverse conveyance path 300 or in the direction in which the sheet S is drawn out from the reverse conveyance path 300. As a result, the sheet S is not able to wait in the reverse conveyance path 300 by stopping the SB roller 117.

As a configuration in which the rotation direction of the SB roller 117 is switched by the solenoid 400, for example, a configuration in which two gear drive trains are arranged between the motor 302 and the SB roller 117 is considered. When the motor 302 is engaged with the first gear drive train, the SB roller 117 rotates in the direction in which the sheet S is drawn to the reverse conveyance path 300. On the other hand, when the motor 302 is engaged with the second gear drive train, the SB roller 117 rotates in the direction in which the sheet S is drawn out from the reverse conveyance path 300. Then, the solenoid 400 switches a state where the motor 302 is engaged with any one of the gear drive trains to a state where the motor 302 is engaged with the other gear drive train.

A double-sided conveyance roller 118 conveys the sheet S, which is conveyed to the double-sided conveyance path 301, to the downstream side. At timing when the sheet S reaches a double-sided feeding roller 120 serving as a second conveyance unit after a predetermined time has lapsed after the leading edge of the sheet S is detected by a double-sided conveyance sensor 119, the conveyance of the sheet S is stopped. When printing is ready, the double-sided conveyance roller 118 and the double-sided feeding roller 120 rotate again to convey the sheet S to the image forming unit. Thereby, an image is printed on a second side (back side) of the sheet S. Timing when printing is ready is decided based on timing when the leading edge or tail edge of the sheet S is detected by the top sensor 107. After printing ends, the flapper 121 is switched to the discharge direction so that the sheet S is discharged onto the discharge tray 123 by the discharge roller 116.

Figure 2:
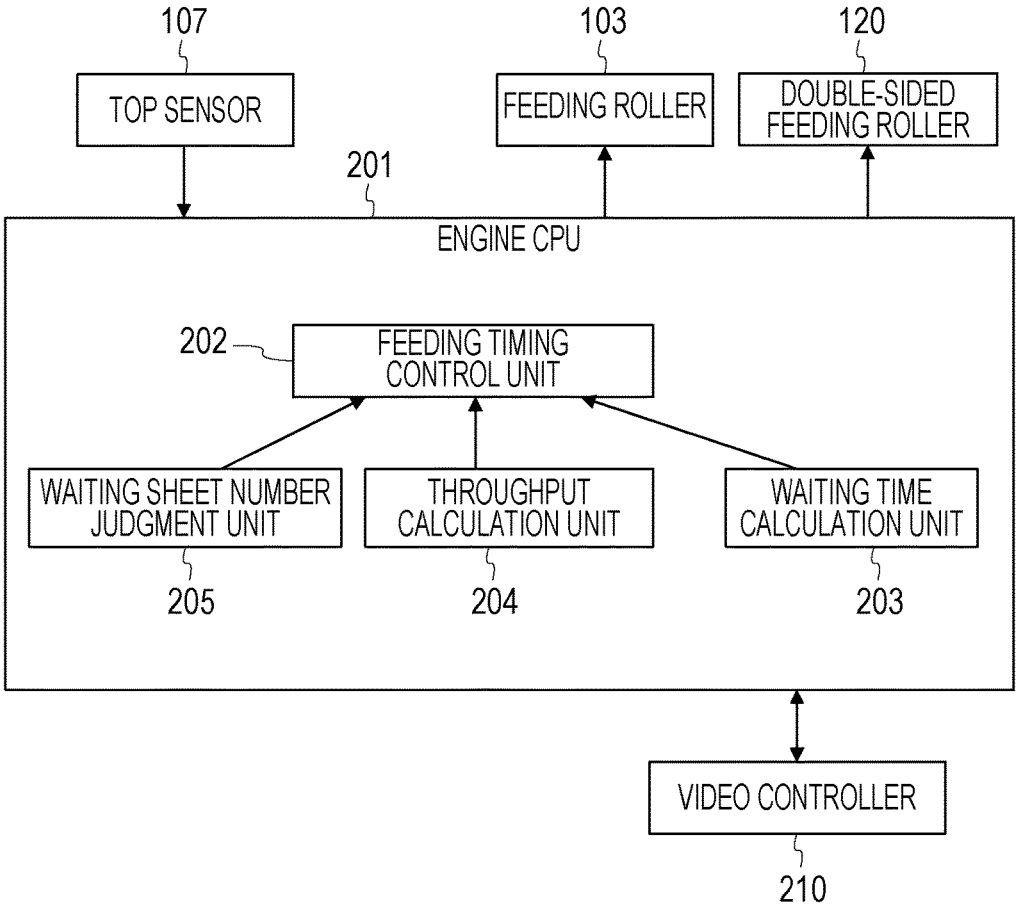
FIG. 2 is a control block diagram of the image forming apparatus in Embodiment 1.
Figure 3A:
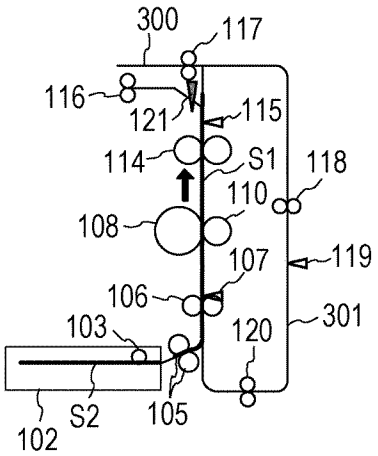
FIGS. 3A to 3F illustrate a method of conveying sheets when double-sided printing is performed for a plurality of sheets.
Figure 3B:
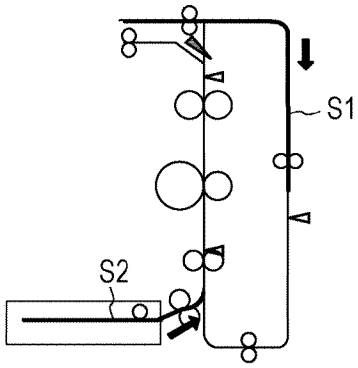
Figure 3C:
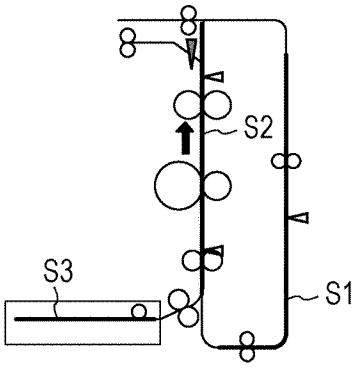
Figure 3D:
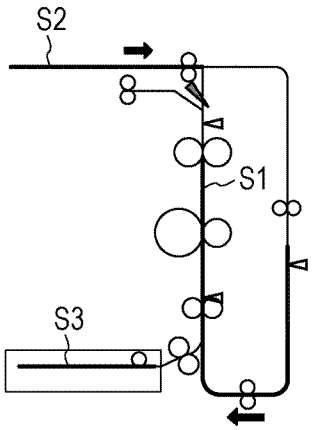
Figure 3E:
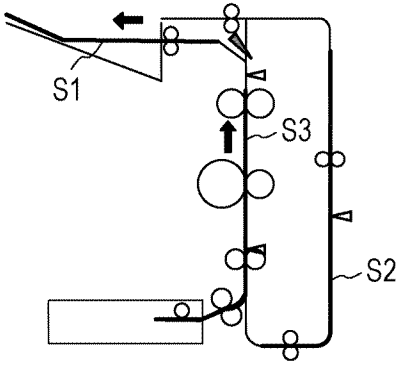
Figure 3F:
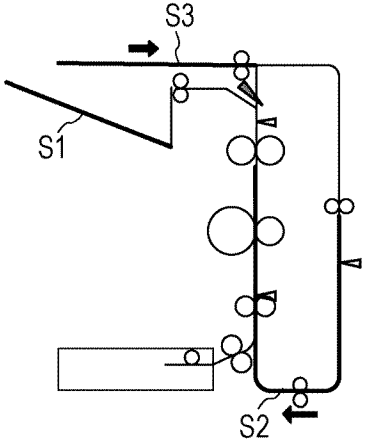

FIG. 2 is a control block diagram of the printer 101 in the present embodiment. The printer 101 has the engine CPU 201 (hereinafter, represented as the CPU 201) that controls an operation thereof. The CPU 201 has an arithmetic processing circuit, a ROM, a RAM, and the like inside thereof and executes processing based on a program written in the ROM in advance.

As illustrated in FIG. 2, the CPU 201 is constituted by a feeding timing control unit 202, a waiting time calculation unit 203, a throughput calculation unit 204, and a waiting sheet number judgment unit 205. The feeding timing control unit 202 controls the feeding roller 103 and the double-sided feeding roller 120 to thereby control timing when the sheet S is fed from the cassette 102 or the double-sided conveyance path 301, and details thereof will be described later. The CPU 201 is connected to the top sensor 107. The video controller 210 transmits a printing condition (image formation condition), a print instruction, image data, or the like to the CPU 201.

A case where double-sided printing is executed on a plurality of sheets S will be described with use of FIGS. 3A to 3F. FIGS. 3A to 3F illustrate a method of conveying the sheets S. Note that, since the rollers, the sensors, and the like on the conveyance paths, which are illustrated in FIGS. 3A to 3F, are the same, reference signs are given in FIG. 3A.

(A) The feeding roller 103 rotates and a first sheet S1 is fed from the cassette 102. An image is printed on a first side of the sheet S1. The sheet S1 having the image printed on the first side thereof is conveyed toward the reverse conveyance path 300.

(B) Without causing the sheet S1 to wait in the reverse conveyance path 300, the SB roller 117 is reversed to convey the sheet S1 to the double-sided conveyance path 301. The double-sided conveyance roller 118 conveys the sheet S1 to the downstream side in the double-sided conveyance path 301. Further, the feeding roller 103 rotates again and a second sheet S2 is fed from the cassette 102.

(C) The sheet S1 is conveyed by the double-sided conveyance roller 118, and in accordance with timing when a leading edge of the sheet S1 is detected by the double-sided conveyance sensor 119, a double-sided conveyance operation is completed. Until timing when printing of the sheet S1 is ready has come, the rotation of the double-sided conveyance roller 118 and the double-sided feeding roller 120 is stopped. An image is printed on a first side of the sheet S2. The sheet S2 having the image printed on the first side thereof is conveyed toward the reverse conveyance path 300.

Note that, in a case where the sheet S1 needs to wait for a long time in the double-sided conveyance path 301, for example, because an instruction to perform printing on a second side of the sheet S1 is not transmitted from the video controller 210 to the CPU 201, the CPU 201 automatically discharges the sheet S1 and the sheet S2 as a print error. This is because, since the sheet S2 is not able to wait in the reverse conveyance path 300 by stopping the SB roller 117, the sheet S2 collides (contacts) with the sheet S1 that is waiting in the double-sided conveyance path 301 and jamming (sheet jamming) is caused.

(D) At the timing when printing is ready, the double-sided conveyance roller 118 and the double-sided feeding roller 120 rotate to convey the sheet S1 from the double-sided conveyance path 301. An image is printed on the second side of the sheet S1. Without causing the sheet S2 to wait in the reverse conveyance path 300, the SB roller 117 is reversed to convey the sheet S2 to the double-sided conveyance path 301.

(E) The sheet S1 having the image printed on the second side thereof is discharged by the discharge roller 116. Until timing when a double-sided conveyance operation is completed and printing is ready has come, the sheet S2 stops. The feeding roller 103 rotates again and a third sheet S3 is fed from the cassette 102. An image is printed on a first side of the sheet S3. The sheet S3 having the image printed on the first side thereof is conveyed toward the reverse conveyance path 300.

(F) Without causing the sheet S3 to wait in the reverse conveyance path 300, the SB roller 117 is reversed to convey the sheet S3 to the double-sided conveyance path 301. At the timing when printing is ready, the double-sided conveyance roller 118 and the double-sided feeding roller 120 rotate to convey the sheet S2 from the double-sided conveyance path 301. An image is printed on a second side of the sheet S2.

Thereafter, by alternately performing feeding from the cassette 102 and feeding from the double-sided conveyance path 301 sequentially, consecutive double-sided printing is realized.

Processing of the waiting sheet number judgment unit 205 (illustrated in FIG. 2) will be described with use of FIG. 4. The waiting sheet number judgment unit 205 judges the maximum waiting sheet number of sheets S in the double-sided conveyance path 301. The number of sheets allowed to wait in the double-sided conveyance path 301 varies in accordance with a configuration of the printer 101. It also varies in accordance with a length (a length in the conveyance direction) of the sheet S to be conveyed. In a case where a distance between the double-sided reverse position Psb and a double-sided waiting position Pst in the double-sided conveyance path 301 is L1 and the length of the sheet S to be conveyed is Lpap, when a relation of $L1<Lpap$ is met, the waiting sheet number judgment unit 205 (illustrated in FIG. 2) judges that the number of sheets allowed to wait is 0. Such judgment is made to prevent the sheets S from overlapping with each other in the double-sided conveyance path 301. When the number of sheets is 0, without performing alternate feeding described in FIGS. 3A to 3F, for example, the sheet S1 is fed from the cassette 102 and an image is printed on the first side thereof, and then, the sheet S1 is fed from the double-sided conveyance path 301 and an image is printed on the second side thereof. Similar control is executed also for the second and subsequent sheets S. In the present embodiment, a case where the number of sheets allowed to wait is one as illustrated in FIGS. 3A to 3F will be described.

Figure 5:
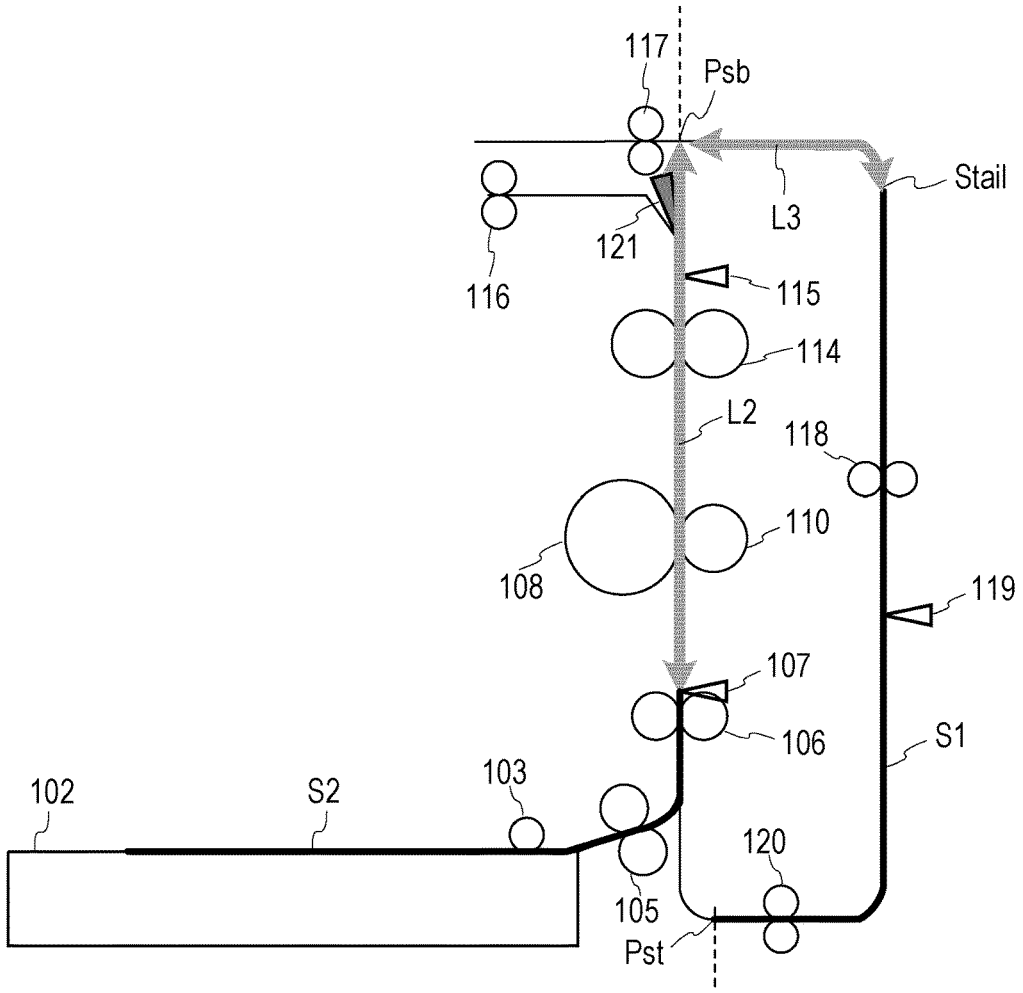
FIG. 5 illustrates a relation of a distance between a sheet waiting in the double-sided conveyance path and a sheet fed from a cassette.

Processing of the waiting time calculation unit 203 (illustrated in FIG. 2) will be described with use of FIG. 5. FIG. 5 illustrates a state where one sheet S1 waits in the double-sided conveyance path 301. In a case where timing when a leading edge of a subsequent sheet S2 to be fed from the cassette 102 is detected by the top sensor 107 is set as a reference, a maximum waiting time Twait during which the sheet S1 is able to wait in the double-sided conveyance path 301 is calculated by a following formula 1.

$$Twait=(\text{length of sheet } S2+L2+L3-Lmargin)/\text{conveyance speed of sheet } S2 \quad \text{(formula 1)}$$

L2=distance between top sensor 107 and Psb in conveyance path

L3=distance between Psb and Stail (position of tail edge of sheet S1) in conveyance path Lmargin=margin distance for preventing contact of sheet S1 and sheet S2

For simplification, it is set that the sheet S1 and the sheet S2 have the same length in the present embodiment. The length of the sheet S2 is obtained by detecting a position of a tail-edge regulator (not illustrated) provided in the cassette 102. The length of the sheet S2 may be set by a user from an operation panel (not illustrated) provided in the printer 101, or information about the length of the sheet S2 may be included in information of a print instruction transmitted from the video controller 210. Further, the length of the sheet S1 also is able to be obtained based on a time until the top sensor 107 detects the tail edge of the sheet S1 after detecting a leading edge of the sheet S1 and the conveyance speed of the sheet S1. Since the sheet S1 and the sheet S2 have the same length, the length of the sheet S2 is able to be indirectly obtained. Moreover, L2 and Lmargin are stored in the ROM (not illustrated) of the CPU 201 in advance, and L3 also is able to be obtained by subtracting the length of the sheet S1 from L1 described above. The calculation described above is executed by the waiting time calculation unit 203.

Accordingly, when the sheet S1 waiting in the double-sided conveyance path 301 is conveyed at timing when Twait has lapsed after timing when the leading edge of the sheet S2 is detected by the top sensor 107 or at timing before that, the sheet S1 and the sheet S2 do not collide with each other.

Next, processing of the throughput calculation unit 204 (illustrated in FIG. 2) will be described. The throughput calculation unit 204 calculates a conveyance interval time Tp of the sheets S based on an image formation condition of the image forming unit. In this case, the image formation condition corresponds to an image formation mode according to a type (thin paper, plain paper, or thick paper) or a size of the sheet S, and the conveyance interval time Tp corresponds to a sheet interval of the sheets S. The sheet interval indicates a distance between a tail edge of a foregoing sheet S and a leading edge of a subsequent sheet S. For example, when the sheet S is thick paper, higher temperature is required to fix an image compared to a case where the sheet S is thin paper. Thus, the conveyance interval time Tp is set to be long in order to secure a sufficient sheet interval. Note that, a type or size of the sheet S is able to be acquired from printing information transmitted from the video controller 210. Similar to the waiting time calculation unit 203, the throughput calculation unit 204 also calculates a time until conveyance of the sheet S1 is started from timing when the leading edge of the sheet S2 is detected by the top sensor 107.

Accordingly, by conveying the sheet S1, which is waiting in the double-sided conveyance path 301, at timing when Tp has lapsed after the timing when the leading edge of the sheet S2 is detected by the top sensor 107, an image is able to be printed on the sheet S1 without reducing image quality.

Note that, the maximum waiting time Twait and the conveyance interval time Tp are calculated based on the timing when the leading edge of the sheet S2 is detected by the top sensor 107, but there is no limitation thereto. For example, the maximum waiting time Twait and the conveyance interval time Tp may be calculated based on timing when feeding of the sheet S2 from the cassette 102 is started by the feeding roller 103. That is, the top sensor 107 is not essential.

Figures 6A, 6B:
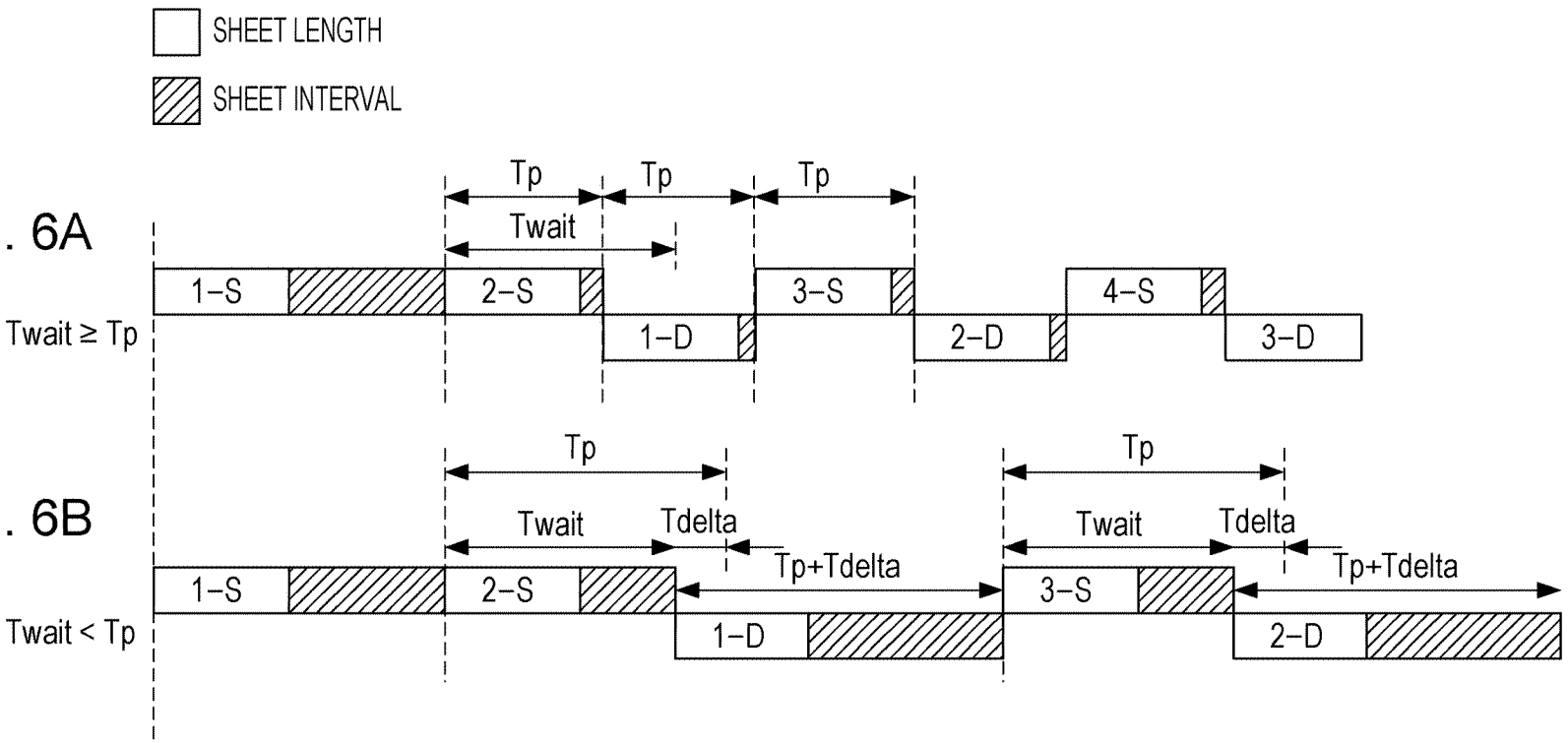
FIGS. 6A and 6B illustrate a relation between Twait and Tp.

FIGS. 6A and 6B illustrate a relation between Twait calculated by the waiting time calculation unit 203 and Tp calculated by the throughput calculation unit 204. As described with FIGS. 3A to 3F, after an image is printed on a first side of a first sheet, an image is printed on a first side of a second sheet, a second side of the first sheet, and a first side of a third sheet in this order in the present embodiment. Here, for example, the first side of the first sheet and a second side of the second sheet are respectively represented as (1-S) and (2-D) in FIGS. 6A and 6B. That is, the first number indicates what number the sheet S is, and S and D respectively represent a first side and a second side.

FIG. 6A illustrates a case of Twait≥Tp. In this case, feeding at the interval of Tp makes it possible to print an image on the sheet S so as to prevent contact of sheets S in the double-sided conveyance path 301 and reduction in image quality.

FIG. 6B illustrates a case of Twait<Tp. In this case, when feeding is performed so that an interval between 2-S and 1-D is Tp, the first sheet S1 waits in the double-sided conveyance path 301 for a long time, and hence collides with the subsequent second sheet S2. Thus, feeding is performed so that the interval between 2-S and 1-D is Twait in the present embodiment. At this time, image quality of 1-D is considered to be reduced due to insufficient fixing temperature, but there is no issue because an interval between 1-S and 2-S is sufficiently wide.

Next, when feeding is performed so that an interval between 1-D and 3-S is Tp, an image is fixed onto 3-S without reduction in quality. However, an interval between 3-S and 2-D is able to be secured only by Twait, so that fixing temperature for an image of next 2-D is insufficient and quality thereof may be reduced. Thus, in the present embodiment, feeding is performed by making the interval between 1-D and 3-S wide in advance by a difference Tdelta between Tp and Twait.

Figure 7:
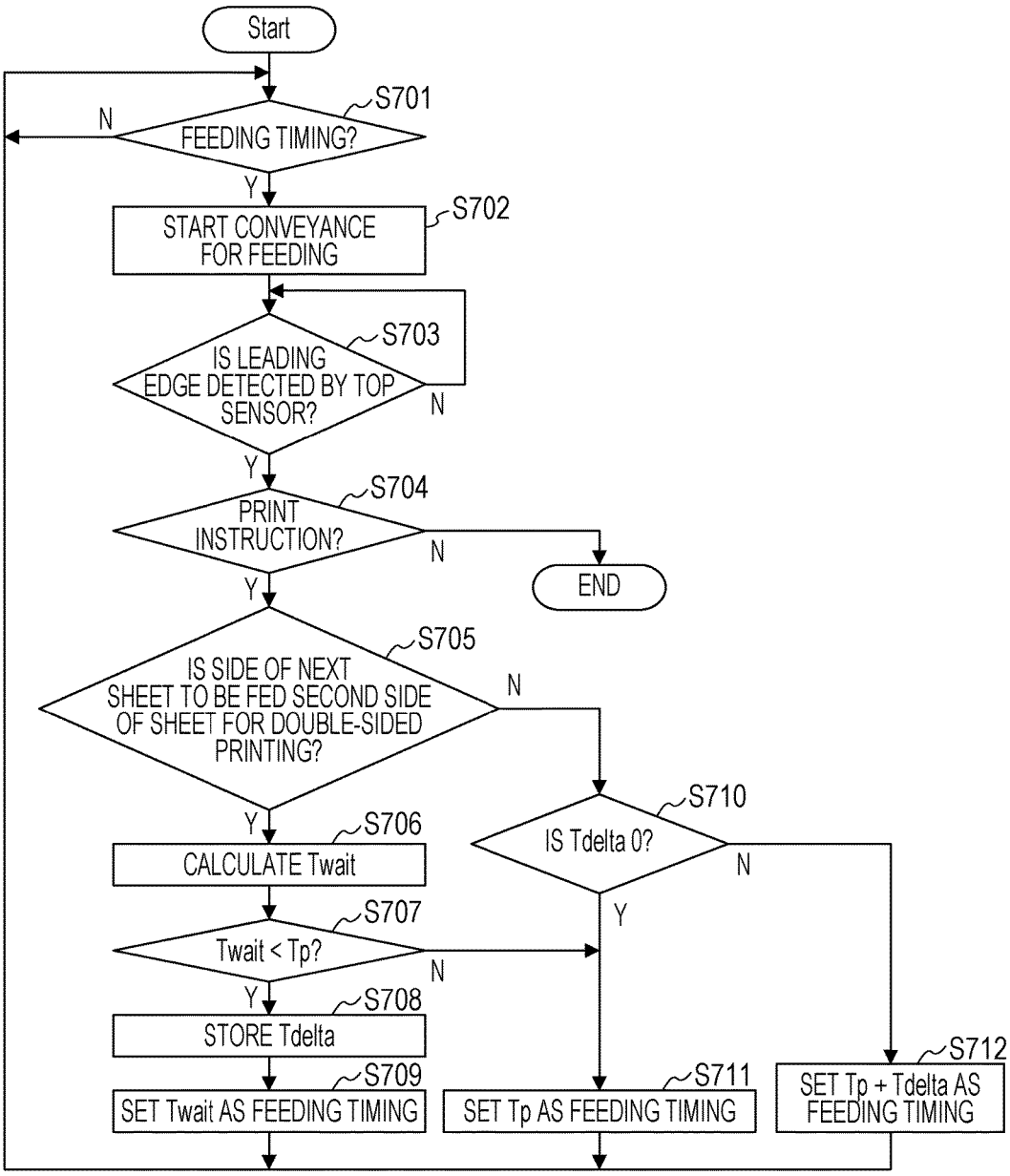
FIG. 7 is a flowchart of double-sided printing of Embodiment 1.

FIG. 7 is a flowchart in the present embodiment. Control according to the flowchart of FIG. 7 is executed by the CPU 201 in accordance with a program stored in the ROM (not illustrated). When the CPU 201 receives a print instruction from the video controller 210, the CPU 201 makes preparation for printing. When completing the preparation for printing, the CPU 201 waits until feeding timing is reached at step 701 (hereinafter, represented as S701). Timing when a first sheet S is fed in a print job is timing when preparation for a feeding operation is completed. In addition, 0 is set as an initial value of Tdelta.

When the feeding timing is reached at S701, the CPU 201 starts the feeding operation at S702. When a sheet to be fed is the sheet S stacked on the cassette 102, the feeding operation is performed by the feeding roller 103. When a sheet to be fed is the sheet S in the double-sided conveyance path 301, the feeding operation is performed by the double-sided feeding roller 120. After the feeding operation is started at S702, the CPU 201 waits until the fed sheet S reaches the top sensor 107 (S703). At timing when a leading edge of the sheet S is detected by the top sensor 107, the CPU 201 proceeds to step S704. At step S704, the CPU 201 checks whether there is still a print instruction, and when there is no print instruction, a printing operation ends. When there is a print instruction, the procedure proceeds to S705.

At S705, the CPU 201 judges whether a sheet to be fed next is the sheet S in the double-sided conveyance path 301. That is, the CPU 201 judges whether the next printing is to be performed for a second side. When the CPU 201 judges that the next printing is to be performed for the second side, the procedure proceeds to S706 to calculate Twait by the waiting time calculation unit 203. After that, the procedure proceeds to S707 and Tp is calculated by the throughput calculation unit 204 in accordance with information from the video controller 210. The feeding timing control unit 202 compares values of Twait and Tp, and when Tp has a greater value, the procedure proceeds to S708. The feeding timing control unit 202 stores a difference value Tdelta between Tp and Twait at S708 and the procedure proceeds to S709. At S709, the feeding timing control unit 202 sets Twait as the feeding timing and returns to S701 to wait until the feeding timing is reached. When Tp is equal to or less than Twait at S707, the procedure proceeds to S711. The feeding timing control unit 202 sets Tp as the feeding timing at S711 and returns to S701 to wait until the feeding timing is reached.

When the CPU 201 judges that the next printing is not to be performed for the second side, that is, for a first side at S705, the procedure proceeds to S710. At S710, the CPU 201 checks whether the value of Tdelta is 0. When the value of Tdelta is 0, the procedure proceeds to S711, and the feeding timing control unit 202 sets Tp as the feeding timing and returns to S701 to wait until the feeding timing is reached. When Tdelta is not 0, the procedure proceeds to S712, and the feeding timing control unit 202 sets Tp+Tdelta as the feeding timing and returns to S701 to wait until the feeding timing is reached. Note that, the feeding timing control unit 202 sets 0 as Tdelta at S712.

Accordingly, with the present embodiment, in a configuration in which a recording material is not allowed to wait in the reverse unit, printing is able to be performed on both sides of a plurality of recording materials while keeping image quality regardless of types or sizes of the recording materials without reducing usability.

Embodiment 2

A method of adding the difference value Tdelta between Tp and Twait to a feeding interval for a subsequent sheet S is indicated in Embodiment 1. In the present embodiment, control for further extending Tdelta in accordance with temperature of the fixing device 114 will be described. Description for a main part is similar to that of Embodiment 1, so that only a part different from that of Embodiment 1 will be described here.

Figure 8:
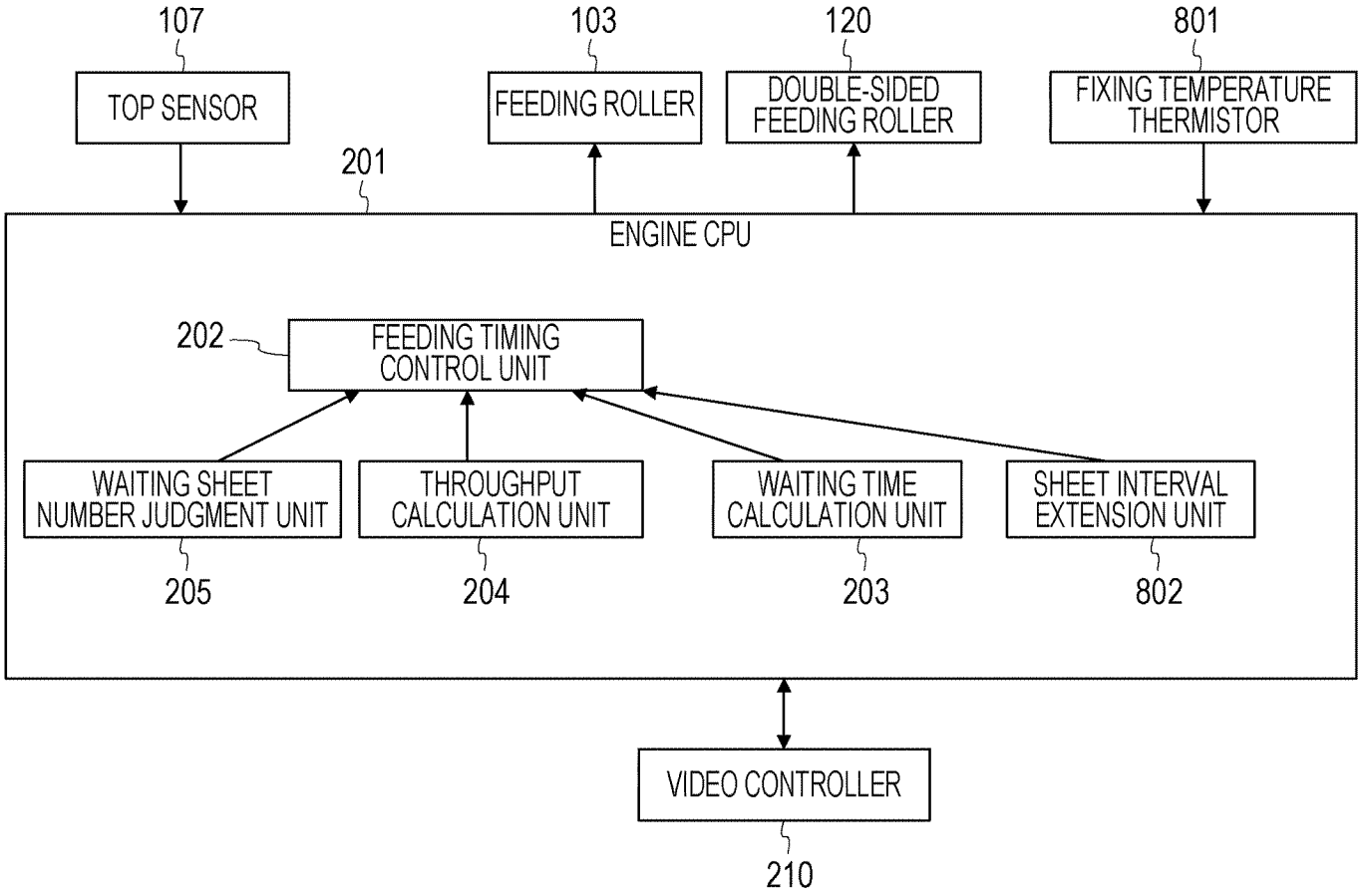
FIG. 8 is a control block diagram of an image forming apparatus in Embodiment 2.

FIG. 8 is a control block diagram of the printer 101 in the present embodiment and is different from the control block diagram of embodiment 1 in that a fixing temperature thermistor 801 serving as a detection unit and a sheet interval extension unit 802 are added. The fixing temperature thermistor 801 detects temperature of a roller (fixing member) included in the fixing device 114. More specifically, the fixing temperature thermistor 801 detects temperature of an end portion of the roller in a direction (hereinafter, represented as a width direction) orthogonal to the conveyance direction of the sheet S. The fixing temperature thermistor 801 may be provided at each end portion. The sheet interval extension unit 802 adds an extension time Text to Tdelta in accordance with the temperature detected by the fixing temperature thermistor 801.

Description will be given for a reason of extending a sheet interval based on the temperature of the fixing device 114. When sheets S each having a small size in a width direction are continuously subjected to printing, the temperature of the end portion of the roller in the fixing device 114 abnormally rises. This results from that while heat of the roller in the fixing device 114 in a region through which the sheet S has passed is taken by the sheet S and therefore temperature decreases, heat of the roller in the fixing device 114 in a region through which the sheet S has not passed is not taken by the sheet S and therefore temperature does not decrease. Thus, in the case of continuous printing as described above, the process may make the sheet interval wide and suppress power supplied to the fixing device 114 so as to smooth the temperature of a center portion and the end portion of the roller.

Figure 9:
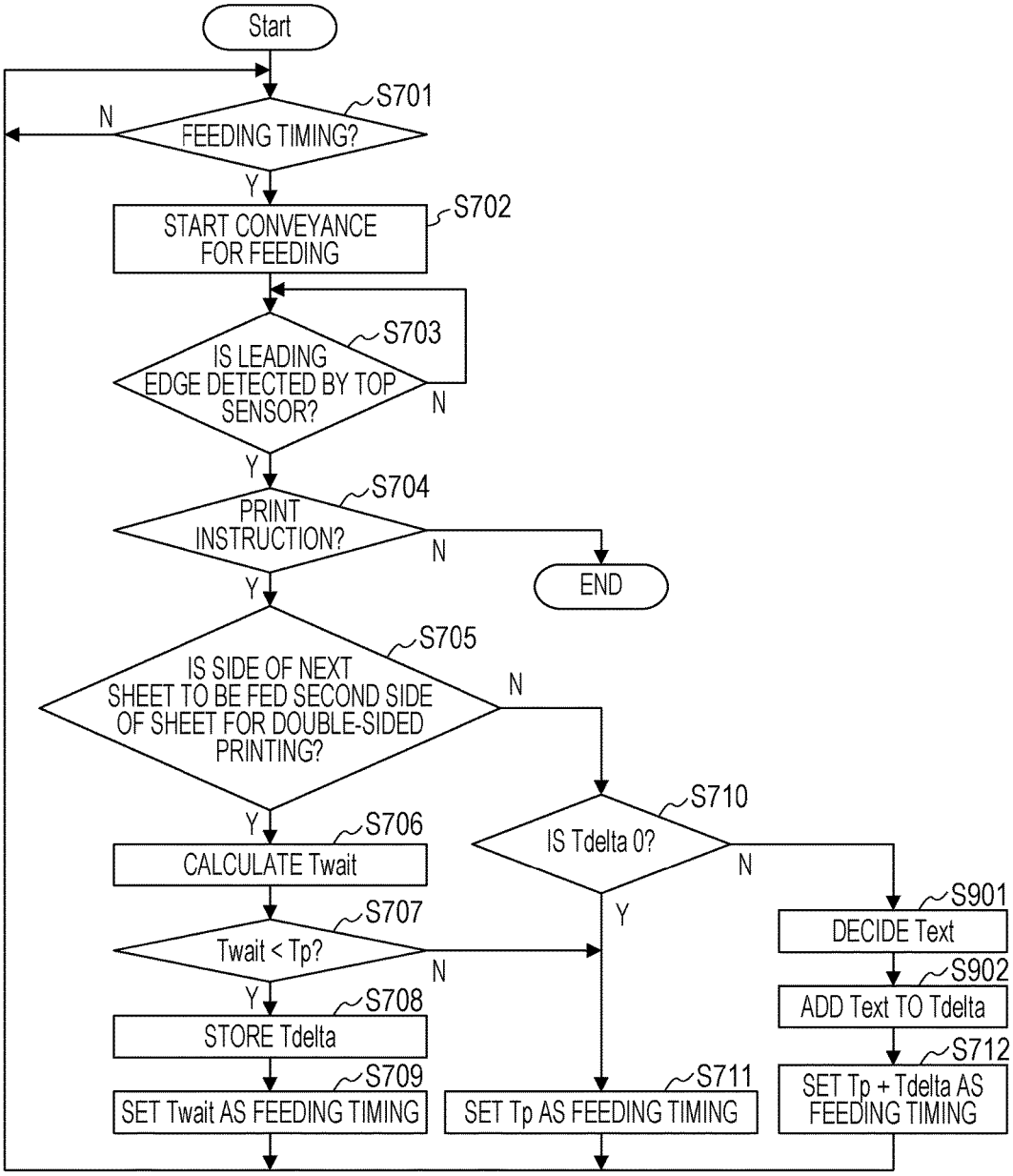
FIG. 9 is a flowchart of double-sided printing of Embodiment 2.

FIG. 9 is a flowchart in the present embodiment. Control according to the flowchart of FIG. 9 is executed by the CPU 201 in accordance with a program stored in the ROM (not illustrated). The flowchart is different from the flowchart of Embodiment 1 in that S901 and S902 are added.

First, at S710, the CPU 201 checks whether the value of Tdelta is 0. When the value of Tdelta is 0, the CPU 201 proceeds to S711 similarly to Embodiment 1 and carries out the processing described above. When the value of Tdelta is not 0, the CPU 201 proceeds to S901 and decides Text. The sheet interval extension unit 802 judges whether the temperature detected by the fixing temperature thermistor 801 exceeds threshold temperature, for example, as indicated in Table and decides Text.

TABLE

| | Temperature of fixing temperature thermistor (less than 235° C.) | Temperature of fixing temperature thermistor (235° C. or more and less than 245° C.) | Temperature of fixing temperature thermistor (245° C. or more) |
|---|---|---|---|
| Text (second) | 0 | 1 | 2 |

Note that, the fixing temperature thermistor 801 may be provided at the center portion and the end portion in a width direction to decide Text based on a temperature difference between the center portion and the end portion. When Text is decided at S901, the CPU 201 proceeds to S902 and adds Text to Tdelta. Then, the procedure proceeds to S712, and the feeding timing control unit 202 sets Tp+Tdelta as the feeding timing and returns to S701 to wait until the feeding timing is reached. Note that, the feeding timing control unit 202 sets 0 as Tdelta at S712.

Accordingly, with the present embodiment, in a configuration in which a recording material is not allowed to wait in the reverse unit, printing is able to be performed on both sides of a plurality of recording materials while keeping image quality regardless of types or sizes of the recording materials without reducing usability.

Note that, in the embodiment described above, in a case of Twait<Tp, when an image is fixed onto a sheet (for example, 1-D in FIG. 6B) fed at the interval of Twait, control may be performed so that power supplied to the fixing device 114 is temporarily increased to increase fixing temperature. In the case of Twait<Tp, feeding may not be performed at the interval of Twait and feeding may be performed at an interval of Twait_s narrower than Twait. In such a case, Tdelta is obtained from a difference between Tp and Twait_s.

Figure 4:
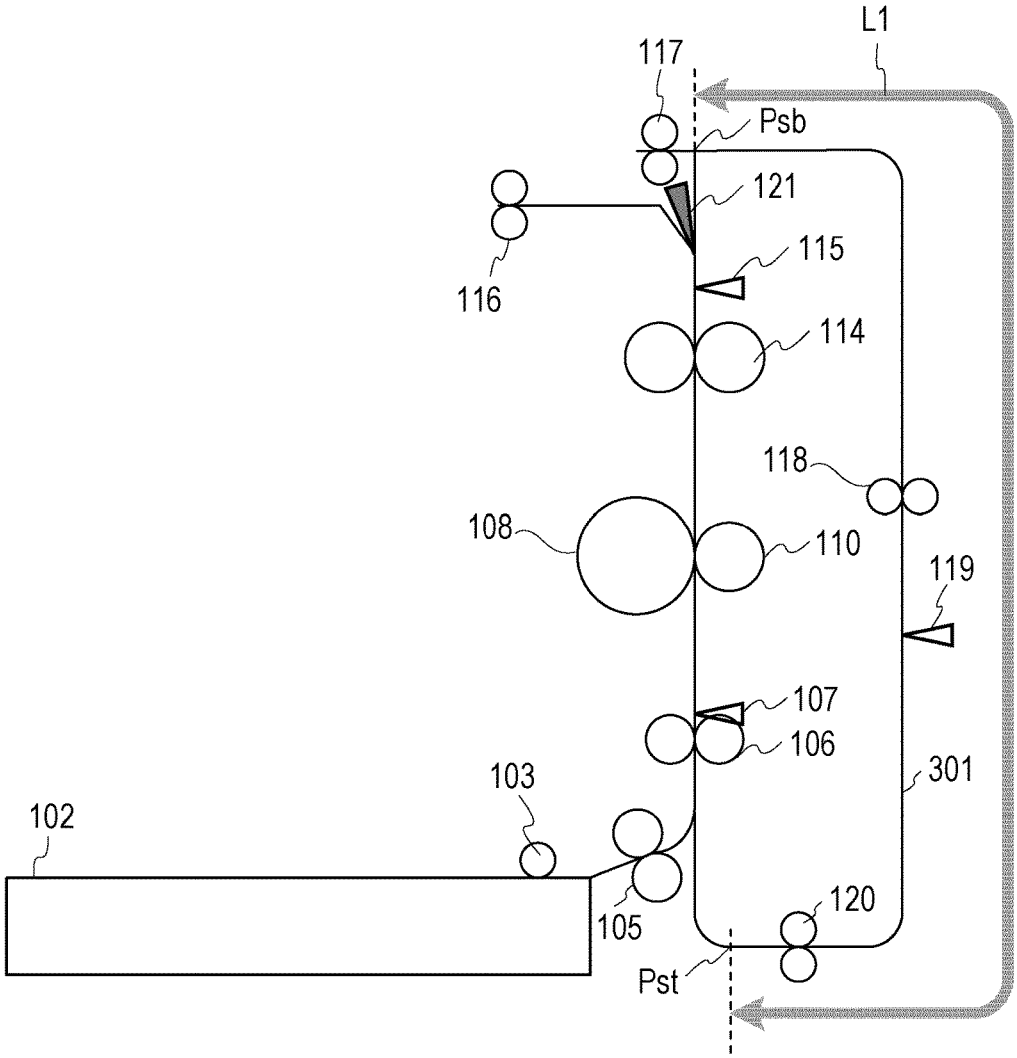
FIG. 4 is a view for explaining the number of sheets allowed to wait in a double-sided conveyance path.

Note that, the embodiments described above provide a configuration in which one sheet S is allowed to wait in the double-sided conveyance path 301 as described with use of FIG. 4. However, there is no limitation thereto, and two or more sheets S may be allowed to wait in the double-sided conveyance path 301.

While the present invention has been described with reference to embodiments, it is to be understood that the invention is not limited to the disclosed embodiments. The scope of the following claims is to be accorded the broadest interpretation so as to encompass all such modifications and equivalent structures and functions.

This application claims the benefit of Japanese Patent Application No. 2016-091446 filed Apr. 28, 2016, which is hereby incorporated by reference herein in its entirety.

What is claimed is:

1. An image forming apparatus comprising:

an image forming unit that forms an image on a recording material;

a stack unit on which a plurality of recording materials are stacked;

a first conveyance unit that conveys a recording material from the stack unit to the image forming unit;

a reverse unit that reverses a conveyance direction of a recording material, which passes through the image forming unit and is conveyed to a reverse conveyance path, and conveys the recording material to a double-sided conveyance path connected to the image forming unit;

a second conveyance unit that conveys a recording material from the double-sided conveyance path to the image forming unit, wherein, without causing a recording material to wait in the reverse unit, the first conveyance unit conveys a first recording material from the stack unit, then the second conveyance unit conveys a second recording material waiting in the double-sided conveyance path after passing through the image forming unit, and subsequently the first conveyance unit conveys a third recording material from the stack unit;

a first calculation unit that calculates a conveyance interval time of a recording material based on an image formation condition of the image forming unit;

a second calculation unit that calculates a maximum waiting time, during which the second recording material is allowed to wait in the double-sided conveyance path after conveyance of the first recording material is started by the first conveyance unit, so as to prevent the first recording material from contacting the second material; and a control unit that, when the conveyance interval time calculated by the first calculation unit is longer than the maximum waiting time calculated by the second calculation unit, starts conveyance of the second recording material by the second conveyance unit at timing at a lapse of a first time shorter than or equal to the maximum waiting time after the conveyance of the first recording material is started by the first conveyance unit, and further starts conveyance of the third recording material by the first conveyance unit at timing at a lapse of a second time obtained by adding a time difference between the conveyance interval time and the first time to the conveyance interval time after the conveyance of the second recording material is started by the second conveyance unit.

2. The image forming apparatus according to claim 1, wherein when the conveyance interval time is shorter than the maximum waiting time, the control unit starts the conveyance of the second recording material by the second conveyance unit at timing at a lapse of the conveyance interval time after the conveyance of the first recording material is started by the first conveyance unit, and further starts the conveyance of the third recording material by the first conveyance unit at timing at a lapse of the conveyance interval time after the conveyance of the second recording material is started by the second conveyance unit.

3. The image forming apparatus according to claim 1, wherein when the conveyance interval time is equal to the maximum waiting time, the control unit starts the conveyance of the second recording material by the second conveyance unit at timing at a lapse of the maximum waiting time after the conveyance of the first recording material is started by the first conveyance unit, and further starts the conveyance of the third recording material by the first conveyance unit at timing at a lapse of the maximum waiting time after the conveyance of the second recording material is started by the second conveyance unit.

4. The image forming apparatus according to claim 1, wherein, when a recording material is thick, the first calculation unit calculates the conveyance interval time so as to be longer compared to a case where the recording material is thin.

5. The image forming apparatus according to claim 1, wherein, when a recording material has a small size in a direction orthogonal to a conveyance direction of the recording material, the first calculation unit calculates the conveyance interval time so as to be longer compared to a case where the recording material has a large size in the orthogonal direction.

6. The image forming apparatus according to claim 1, wherein, when a recording material has a small size in a conveyance direction of the recording material, the second calculation unit calculates the maximum waiting time so as to be longer compared to a case where the recording material has a large size in the conveyance direction.

7. The image forming apparatus according to claim 1, wherein the image forming unit includes a fixing member that fixes an image onto a recording material through application of heat, and a detection unit that detects temperature of the fixing member, and wherein, when judging that temperature at an end portion of the fixing member in a direction orthogonal to a conveyance direction of a recoding material exceeds threshold temperature, the control unit adds an extension time obtained by the temperature of the fixing member detected by the detection unit to the second time.

8. The image forming apparatus according to claim 1, wherein the image forming unit includes a fixing member that fixes an image onto a recording material through application of heat, wherein the fixing member and the reverse unit are driven by a same driving source, and wherein a solenoid that switches a rotation direction of the reverse unit is provided between the reverse unit and the driving source.

9. A method for an image forming apparatus having an image forming unit that forms an image on a recording material, and a stack unit on which a plurality of recording materials are stacked, the method comprising:

conveying, via a first conveyance unit, a recording material from the stack unit to the image forming unit;

reversing, via a reverse unit, a conveyance direction of a recording material, which passes through the image forming unit and is conveyed to a reverse conveyance path, and conveying, via the reverse unit, the recording material to a double-sided conveyance path connected to the image forming unit;

conveying, via a second conveyance unit, a recording material from the double-sided conveyance path to the image forming unit, wherein, without causing a recording material to wait in the reverse unit, the first conveyance unit conveys a first recording material from the stack unit, then the second conveyance unit conveys a second recording material waiting in the double-sided conveyance path after passing through the image forming unit, and subsequently the first conveyance unit conveys a third recording material from the stack unit;

calculating, as a first calculation, a conveyance interval time of a recording material based on an image formation condition of the image forming unit;

calculating, as a second calculation, a maximum waiting time, during which the second recording material is allowed to wait in the double-sided conveyance path after conveyance of the first recording material is started by the first conveyance unit, so as to prevent the first recording material from contacting the second material; and when the conveyance interval time calculated by the first calculation is longer than the maximum waiting time calculated by the second calculation, starting conveyance of the second recording material by the second conveyance unit at timing at a lapse of a first time shorter than or equal to the maximum waiting time after the conveyance of the first recording material is started by the first conveyance unit, and further starting conveyance of the third recording material by the first conveyance unit at timing at a lapse of a second time obtained by adding a time difference between the conveyance interval time and the first time to the conveyance interval time after the conveyance of the second recording material is started by the second conveyance unit.

10. A non-transitory computer-readable storage medium storing a program to cause an image forming apparatus to perform a method, wherein the image forming apparatus includes an image forming unit that forms an image on a recording material, and a stack unit on which a plurality of recording materials are stacked, the method comprising:

conveying, via a first conveyance unit, a recording material from the stack unit to the image forming unit;

reversing, via a reverse unit, a conveyance direction of a recording material, which passes through the image forming unit and is conveyed to a reverse conveyance path, and conveying, via the reverse unit, the recording material to a double-sided conveyance path connected to the image forming unit;

conveying, via a second conveyance unit, a recording material from the double-sided conveyance path to the image forming unit, wherein, without causing a recording material to wait in the reverse unit, the first conveyance unit conveys a first recording material from the stack unit, then the second conveyance unit conveys a second recording material waiting in the double-sided conveyance path after passing through the image forming unit, and subsequently the first conveyance unit conveys a third recording material from the stack unit;

calculating, as a first calculation, a conveyance interval time of a recording material based on an image formation condition of the image forming unit;

calculating, as a second calculation, a maximum waiting time, during which the second recording material is allowed to wait in the double-sided conveyance path after conveyance of the first recording material is started by the first conveyance unit, so as to prevent the first recording material from contacting the second material; and when the conveyance interval time calculated by the first calculation is longer than the maximum waiting time calculated by the second calculation, starting conveyance of the second recording material by the second conveyance unit at timing at a lapse of a first time shorter than or equal to the maximum waiting time after the conveyance of the first recording material is started by the first conveyance unit, and further starting conveyance of the third recording material by the first conveyance unit at timing at a lapse of a second time obtained by adding a time difference between the conveyance interval time and the first time to the conveyance interval time after the conveyance of the second recording material is started by the second conveyance unit.

* * * * *